US009206564B2

(12) United States Patent
Marsolek et al.

(10) Patent No.: US 9,206,564 B2
(45) Date of Patent: Dec. 8, 2015

(54) APPARATUS AND METHOD FOR MEASURING ACCELERATING DRUM

(71) Applicant: CATERPILLAR PAVING PRODUCTS INC., Brooklyn Park, MN (US)

(72) Inventors: John L. Marsolek, Watertown, MN (US); Jeffrey A. Renard, Hugo, MN (US); Brian G. Moriarity, Big Lake, MN (US); Joseph A. Lehtola, Buffalo, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 14/264,585

(22) Filed: Apr. 29, 2014

(65) Prior Publication Data

US 2015/0308057 A1 Oct. 29, 2015

(51) Int. Cl.
*E01C 19/28* (2006.01)

(52) U.S. Cl.
CPC ..... *E01C 19/286* (2013.01); *E01C 19/28* (2013.02)

(58) Field of Classification Search
CPC ..... E01C 19/286; E01C 19/28
USPC ..... 404/72, 75, 113, 117, 118, 122
See application file for complete search history.

(56) References Cited

U.S. PATENT DOCUMENTS

| | | | | |
|---|---|---|---|---|
| 3,605,583 | A * | 9/1971 | Keppler | 404/117 |
| 3,797,954 | A * | 3/1974 | Harris | 404/117 |
| 3,909,147 | A * | 9/1975 | Takata | 404/117 |
| 5,164,641 | A | 11/1992 | Quibel et al. | |
| 5,177,415 | A * | 1/1993 | Quibel et al. | 318/128 |
| 6,752,567 | B2 | 6/2004 | Miyamoto et al. | |
| 7,089,823 | B2 | 8/2006 | Potts | |
| 2007/0150147 | A1 | 6/2007 | Rasmussen et al. | |
| 2011/0150372 | A1 * | 6/2011 | Care et al. | 384/1 |

FOREIGN PATENT DOCUMENTS

DE 202004015141 U1 1/2005

* cited by examiner

*Primary Examiner* — Raymond W Addie
(74) *Attorney, Agent, or Firm* — Miller, Matthias & Hull LLP

(57) ABSTRACT

A drum assembly for a vibratory compactor and method of retrofitting a vibratory compactor to measure the acceleration and/or vibratory movement of a drum rotatably mounted on the frame of the vibratory compactor. The drum assembly may comprise a drum including a shell, a mounting wall disposed inside the drum and a bulkhead disposed inside the drum and attached to the shell, a first bearing disposed between the frame and the mounting wall, a second bearing, a sensor, and a strap. The first bearing may include an inner race fixedly mounted to the frame. The second bearing may comprise a hub and a bearing shaft circumscribed by the hub and mounted to the bulkhead of the drum. The strap may be attached to the inner race and the hub.

20 Claims, 4 Drawing Sheets

APPARATUS AND METHOD FOR MEASURING ACCELERATING DRUM

TECHNICAL FIELD

The present disclosure generally relates to measuring systems and, more particularly, for measuring systems for use on vibratory compactor drums to measure the compaction provided by the drum.

BACKGROUND

Compactors are machines used to compact material, such as asphalt, soil, gravel, and the like to a dense surface. Various types of compactors are known in the art. Some compactors include a rotatable roller drum that may be rolled over the surface to compress the material underneath. In addition to utilizing the weight of the roller drum to provide the compressive forces that compact the material, some compactors are configured to also induce a vibratory force to the surface. The vibratory forces assist in compacting the surface into a dense mass.

To generate the vibratory forces one or more weights or masses may be disposed inside the roller drum at a position that is off center from the axis line around which the roller drum rotates. As the roller drum rotates, the position of the masses induce oscillatory or vibrational forces to the drum that are imparted to the surface being compacted.

U.S. Pat. No. 5,164,641 (the '641 Patent) issued Nov. 17, 1992 to Caterpillar Paving Products Inc. discloses an apparatus for controlling the frequency of vibration of a compacting machine. The accelerometer of the '641 Patent is mounted on a nonrotating element of the compactor drum. While this system is beneficial, an apparatus is desired in which a sensor such as an accelerometer may be mounted on an element of the drum that is moveable.

SUMMARY OF THE DISCLOSURE

In accordance with one aspect of the disclosure, a drum assembly of a vibratory compactor having a frame is disclosed. The drum assembly may comprise a drum rotatably mounted on the frame, a first bearing, a second bearing, a sensor, and a strap. The drum may include a shell, a mounting wall disposed inside the drum, and a bulkhead disposed inside the drum and attached to the shell. The first bearing may be disposed between the frame and the mounting wall. The first bearing may include a first bearing inner race fixedly mounted to the frame. The second bearing may comprise a hub, and a bearing shaft circumscribed by the hub and mounted to the bulkhead of the drum. The bearing shaft may be rotatable with the drum. The sensor may be mounted to the hub. The sensor may be configured to measure an acceleration of the drum. The strap has a first end and a second end. The first end may be attached to the first bearing inner race. The second end may be attached to the hub. The strap may be configured to allow movement of the hub with respect to the first bearing inner race.

In accordance with another aspect of the disclosure, a method of retrofitting a vibratory compactor having a drum with a sensor configured to measure the acceleration of the drum is disclosed. The vibratory compactor may include a frame, a drum rotatably mounted on the frame, a first bearing mounted on the frame, and a second bearing mounted inside the drum. The first bearing may include a first bearing inner race that is stationary relative to the drum. The method may comprise mounting the sensor to a portion of the second bearing, attaching a first end of a strap to the first bearing inner race and a second end of the strap to the portion of the second bearing, restricting with the strap a rotational movement of the portion of the second bearing, and placing a communication path between the sensor and a controller mounted on the vibratory compactor. In an embodiment, the strap may be flexible.

In accordance with a further aspect of the disclosure a vibratory compactor is disclosed. The vibratory compactor may include a frame, a drum rotatably mounted on the frame, a vibratory motor mounted to the frame, a drive shaft operably connected to the vibratory motor, a first bearing, a second bearing, a mounting member, a sensor, and a strap. The drum may include a shell, a mounting wall disposed inside the shell, and a bulkhead attached to the shell. The drive shaft may extend through the bulkhead. The first bearing may be disposed between the frame and the mounting wall. The first bearing may include a first bearing outer race mounted to the mounting wall and rotatable with the drum, and a first bearing inner race mounted to the frame. The first bearing inner race may be stationary with respect to the first bearing outer race. The second bearing may be disposed between the mounting wall and the bulkhead and may radially circumscribe the drive shaft. The second bearing may comprise a hub, and a bearing shaft circumscribed by the hub. The bearing shaft may be mounted to the bulkhead of the drum and may be rotatable with the drum. The mounting member may be fixedly attached to the hub. The sensor may be mounted to the mounting member. The sensor may be configured to measure an acceleration of the drum. The strap may have a first end and a second end. The first end may be attached to the first bearing inner race, and the second end may be attached to the hub. The strap may be configured to allow a rotational movement of the hub with respect to the first bearing inner race.

DETAILED DESCRIPTION

Figure 1:
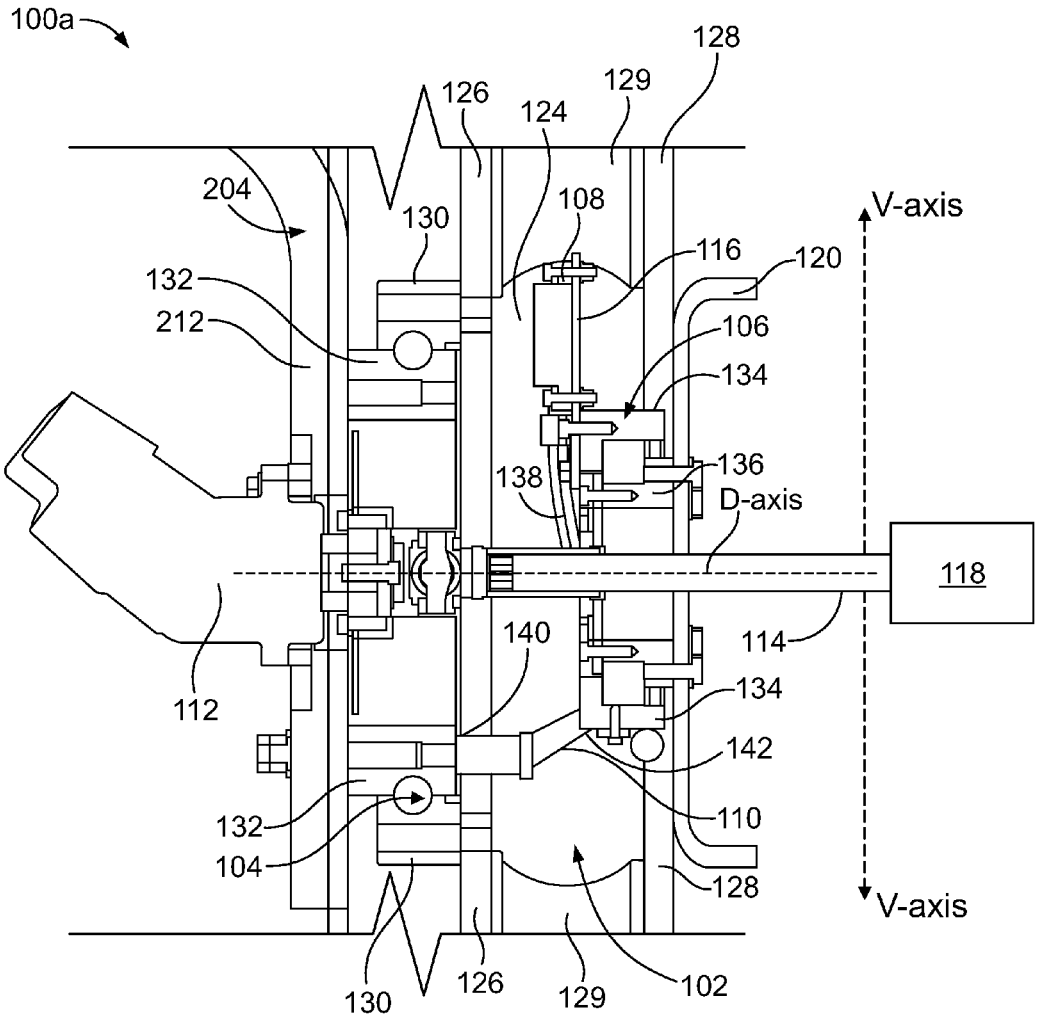
FIG. 1 is a perspective view of a portion of an exemplary embodiment of a drum assembly in accordance with the teachings of this disclosure.
Figure 5:
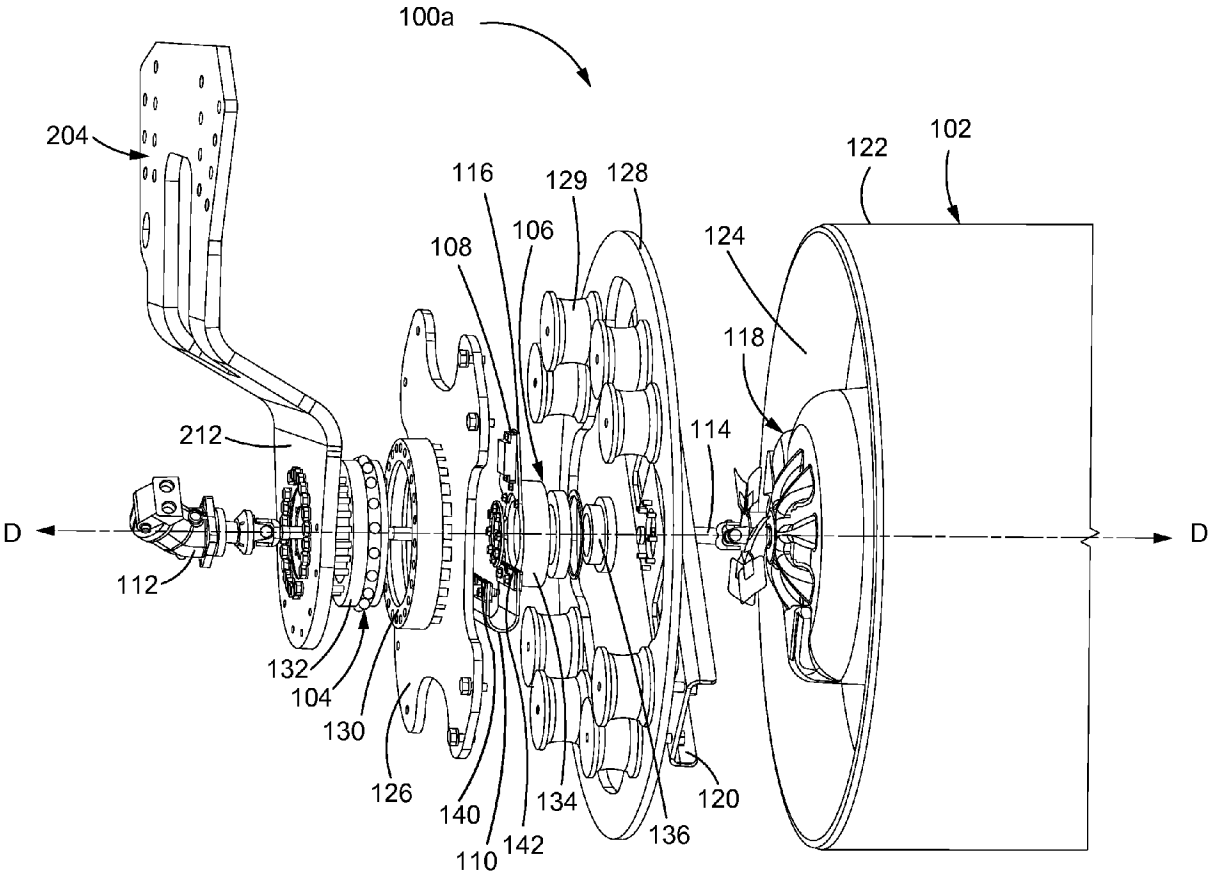
FIG. 5 is an exploded view of an exemplary embodiment of a drum assembly.

Referring now to the drawings, and with specific reference to FIGS. 1 and 5, there is shown a portion of a first drum assembly 100*a* in accordance with the present disclosure and generally referred to by reference numeral 100*a*. The first drum assembly 100*a* may comprise a drum 102, a first bearing 104, a second bearing 106, a sensor 108, and a strap 110. The drum assembly 100*a* may further comprise a vibratory motor 112, a drive shaft 114, a mounting member 116, a vibration assembly 118 and a bracket 120.

This disclosure describes an exemplary embodiment of the first drum assembly 100*a*. While the exemplary embodiment of the first drum assembly 100*a* is described relative to a vibratory compactor 200 with a solid drum 102, the teachings of this disclosure may be employed on other compactors that utilized other types of drums or other types of compaction devices.

Figure 2:
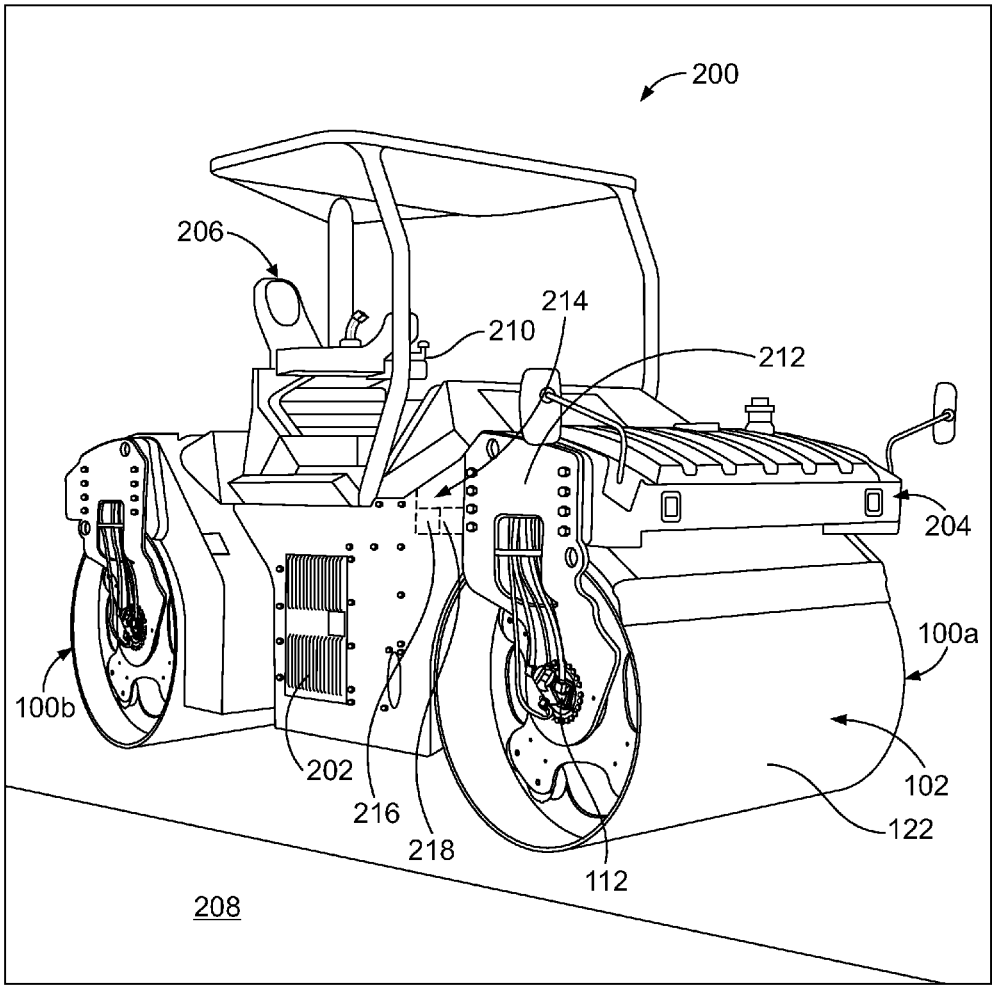
FIG. 2 is perspective view of an embodiment of an exemplary vehicle in which a drum assembly in accordance with the teachings of this disclosure may be used.

FIG. 2 illustrates an exemplary vibratory compactor 200. The vibratory compactor 200 includes an engine 202 configured to generate power to physically move the compactor 200, a frame 204, an operator compartment 206, a first drum assembly 100*a*, a second drum assembly 100*b* and a controller 214. Each drum 102 of the drum assemblies 100*a*, 100*b* is in rolling contact with the surface 208 and is rotatably mounted to the frame 204. The first and second drum assemblies 100*a*, 100*b* support the frame 204 above the surface 208 and allow the compactor 200 to travel over the surface 208. The engine 202 may be any type of engine 202 (internal combustion, gas, diesel, gaseous fuel, natural gas, propane, etc.), may be of any size, with any number of cylinders, and in any configuration ("V," in-line, radial, etc.).

The operator compartment 206 may include a plurality of control devices, such as joysticks, user interfaces, and a display 210 to display operation parameters and the like, and input devices to control various operations.

Turning back to FIG. 1, in some embodiments, the first drum assembly 100*a* may be the same as the second drum assembly 100*b*. In yet other embodiments, the second drum assembly 100*b* may be different from the first drum assembly 100*a*. While in FIG. 2 the first drum assembly 100*a* is shown as disposed near the front of the vibratory compactor 200 and the second drum assembly 100*b* is shown as disposed near the rear of the vibratory compactor 200, in other embodiments, the positions of the first and second drum assemblies 100*a*, 100*b* may be reversed.

In one embodiment, the frame 204 may include a pair of side panels 212. The drum 102 is rotatably mounted on the frame 204. In the embodiment illustrated in FIG. 2, the drum 102 is rotatably mounted on the side panels 212 of the frame 204. The drum 102 includes a generally cylindrical shell 122 (FIG. 2) that defines an interior volume 124 (FIG. 1), a pair of mounting walls 126 disposed inside the shell 122 proximal to the side panels 212 of the frame 204, and a plurality of bulkheads 128 attached to an inner surface of the shell 122. On both ends of the drum 102, one of the mounting walls 126 is disposed between a side panel 212 of the frame 204 and one of the bulkheads 128. In an embodiment, the mounting wall 126 may be isolated from the bulkhead 128 via a damping member 129 such as an isomount. In the embodiment illustrated in FIGS. 1-2, the drum 102 is a "solid drum" as that term is understood by one of ordinary skill in the art. A solid drum is not a solid cylindrical mass but instead is used in the industry to refer to drums 102 that include a single cylinder drum shell 122 on a vibratory compactor 200. The drum assembly 100*a* described herein is not limited to use with a solid drum but may also be utilized with a split drum assembly, which typically utilize two cylindrical drum shells joined together with a bearing that allows differential rotation between the drum shells (each "half" may rotate independently), and other types of drum assemblies used on vibratory compactors 200.

The vibration assembly 118 may be disposed within the interior volume 124 of the drum 102. The vibration assembly 118, as is known in the art for vibratory compactor 200 drum assemblies 100*a*, causes the drum 102 of the drum assembly 100*a* to vibrate and impart compacting forces to the surface 208. Any vibration assembly 118 suitable for use in a drum 102 of a vibratory compactor 200 may be used. In one embodiment, the vibration assembly 118 may include a plurality of eccentric members that rotate with respect to each other to generate a vibratory force within the drum 102.

To cause or drive rotation of the plurality of eccentric members, a vibratory motor 112 may be mounted to the frame 204. In the embodiment illustrated in FIG. 1, the vibratory motor 112 is mounted to a side panel 212 of the frame 204. The vibratory motor 112 may be a hydraulically activated motor, an electromagnetically activated motor or can be powered by some other method.

The drive shaft 114 is operably connected to the vibratory motor 112 and may extend through the bulkhead 128. The drive shaft 114 is rotatable and defines a drive axis D. The drive shaft 114 is operably connected to the vibration assembly 118.

The first bearing 104 is disposed between the side panel 212 and the mounting wall 126. The first bearing 104 allows the drum 102 to rotate relative to the frame 204 and, in doing so, to move the compactor 200 (FIG. 2) over the surface 208. The first bearing 104 (FIG. 1) may include a first bearing outer race 130 and a first bearing inner race 132. Typically, one of the first bearing outer race 130 and the first bearing inner race 132 is stationary with respect to the other that rotates with the drum 102. In the exemplary embodiment, the first bearing outer race 130 circumscribes the first bearing inner race 132 and is mounted to the mounting wall 126. The first bearing outer race 130 is rotatable with the drum 102. The first bearing inner race 132 is mounted to the side panel 212 of the frame 204. In the exemplary embodiment, the first bearing inner race 132 is stationary with respect to the first bearing outer race 130.

The second bearing 106 is disposed between the mounting wall 126 and the bulkhead 128 and radially circumscribes the drive shaft 114. The second bearing 106 may comprise a hub 134, and a bearing shaft 136 circumscribed by the hub 134. The bearing shaft 136 may be mounted to the bulkhead 128 of the drum 102 and/or the bracket 120. In the exemplary embodiment, the bearing shaft 136 is rotatable with the drum 102. The second bearing 106 may radially circumscribe the drive shaft 114.

The mounting member 116 may be fixedly attached to the hub 134. The mounting member 116 may extend radially outward or away from the hub 134. In the embodiment illustrated in FIG. 1, the mounting member 116 also extends in a direction radially outward of the drive shaft 114. The mounting member 116 may be a mounting plate, or the like, on which the sensor 108 may be mounted.

The sensor 108 may be mounted (indirectly) to the hub 134 via the mounting member 116 and is in operable communication with the controller 214 via a communication path 138 that extends from the sensor 108 to the controller 214. The sensor 108 is configured to provide an input signal indicative of acceleration or vibratory movement of the drum 102 to the controller 214 via the communication path 138. The communication path 138 may also extend from the controller 214 to the display 210 in the operator compartment 206. In one embodiment, the communication path 138 may be wired. The sensor 108 may be any sensor or encoder known in the art for measuring the acceleration of the drum 102 or the vibratory movement of the drum 102. The input signals from the sensor 108 may be processed by the controller 214 to determine the compaction provided by the drum 102.

The controller 214 may include a processor 216 and a memory component 218. The processor 216 may be a microprocessor or other processor as known in the art. The processor 216 may execute instructions and generate control signals for processing an input signal indicative of the acceleration or vibratory movement of the drum 102 to determine the compaction, and other parameters, of the vibratory compactor 200. Such instructions that are capable of being executed by a computer may be read into or embodied on a computer readable medium, such as the memory component 218 or provided external to the processor 216. In alternative embodiments, hard wired circuitry may be used in place of, or in combination with, software instructions to implement a control method.

The controller 214 is not limited to one processor 216 and memory component 218. The controller 214 may be several processors 216 and memory components 218.

The strap 110 has a first end 140 and a second end 142. The first end 140 is attached to the first bearing inner race 132, and the second end 142 is attached to the hub 134. The length, shape and/or placement of the strap 110 may be configured to allow a small amount of movement of the hub 134 with respect to the first bearing inner race 132 that is mounted on the side panel 212 of the frame 204. In one embodiment, the rotational movement of the hub 134 about the drive axis D with respect to the first bearing inner race 132 is in the range of about −30 degrees from a vertical axis V to about 30 degrees from a vertical axis V. In another embodiment, the rotational movement of the hub 134 about the drive axis D with respect to the first bearing inner race 132 is in the range of about −10 degrees from the vertical axis V to about 10 degrees from a vertical axis V. In some embodiments, the strap 110 may be a flexible strap 110 that is made from flexible material such as a wire mesh, leather, or an elastomeric material such as rubber, or the like. In some embodiments, the strap 110 may be a cord or cord-shaped. A strap 110 that is a cord may be elastic, wire mesh, leather or the like. The relatively small degree of hub 134 movement relative to the first bearing inner race 132 prevents the communication path 138 from becoming entangled around the second bearing 106 and/or the drive shaft 114. In addition, the flexibility of the strap 110 isolates the first bearing inner race 132 (and the frame 204) from the vibrations experienced by the hub 134 and vibrating portion of the drum 102. Thus, inhibiting the transmission of vibrations from the hub 134 (and vibrating portion of the drum 102) through the communication path 138 to the frame 204 (via the first bearing inner race 132) and to the operator compartment 206. It also reduces the likelihood of distortion of the input signal provided by the sensor 108 to the controller 214 by reducing the likelihood of transfer of vibrations to the communication path 138.

In some embodiment, the drum assembly 100*a* may also include a bracket 120. As shown in FIG. 2, the bearing shaft 136 may be mounted to the bulkhead 128 and the bracket 120. The bulkhead 128 may be disposed between the bearing shaft 136 and the bracket 120.

INDUSTRIAL APPLICABILITY

The features disclosed herein may be particularly beneficial for use with vibratory compactors 200 having a mounted sensor 108 that measures the acceleration or vibratory movement of the rotating drum 102. To provide the desired sensor 108 readings, the sensor 108 is mounted on the vibratory portion of the first drum assembly 100*a* adjacent to rotating elements. The disclosed arrangement allows the sensor 108 to rotate from the vertical axis V to accommodate the movement of the drum assembly 100*a* in relation to the frame 204 while keeping the rotational movement of the sensor 108 relatively minimal to facilitate measurement of the acceleration/vibratory movement of the rotating drum 102 and to eliminate tangling or disconnection of the communication path 138 between the sensor 108 and the controller 214. In addition, the disclosed arrangement and the limited movement of the sensor 108 minimize distortion of the sensor 108 readings and distortion of the transmitted data. In alternative embodiments, that may utilize wireless communication and the like, the relatively minimal movement of the sensor 108 minimizes distortion of the sensor 108 readings and transmission of the data from the sensor 108.

Figure 3:
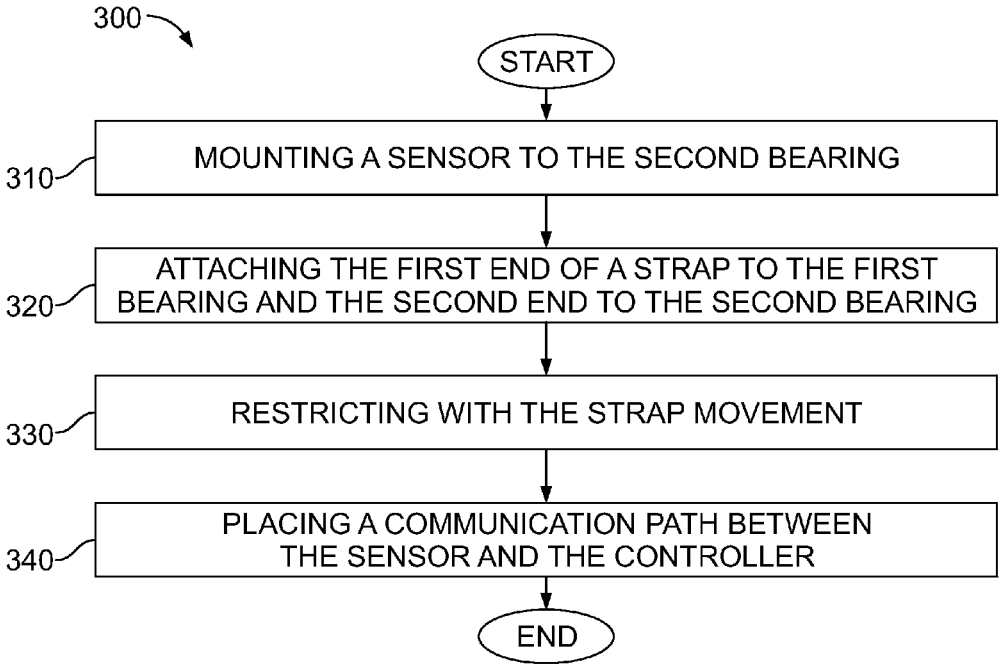
FIG. 3 is a flowchart illustrating exemplary blocks of a method for retrofitting a drum on a vibratory compactor with a sensor configured to measure the acceleration of the drum.

Referring now to FIG. 3, an exemplary flowchart is illustrated showing sample blocks which may be followed in a method of a vibratory compactor 200 having a drum 102 with a sensor 108 configured to measure the acceleration of the drum 102. The vibratory compactor 200 may include a frame 204, the drum 102 rotatably mounted on the frame 204, a first bearing 104 mounted on the frame 204, and a second bearing 106 mounted inside the drum 102. The first bearing 104 may include a first bearing inner race 132 that is stationary relative to the drum 102. The method 300 may be practiced with more or less than the number of blocks shown and is not limited to the order shown.

Block 310 of the method includes mounting the sensor 108 to a portion of the second bearing 106.

In block 320, the method further includes attaching a first end 140 of a flexible strap 110 to the first bearing inner race 132 and a second end 142 of the strap 110 to a portion of the second bearing 106.

In block 330, this method 300 further includes restricting with the strap 110 the rotational movement of the portion of the second 106. In some embodiments, the movement of the portion of the second bearing 106 about the drive axis D may be restricted to the range of about −30 degrees from a vertical axis V to about 30 degrees from a vertical axis V. In other embodiments, the movement of the portion of the second bearing 106 about the drive axis D may be restricted to the range of about −10 degrees from a vertical axis V to about 10 degrees from a vertical axis V. In yet other embodiments, the angular range may be smaller.

In block 340, the method includes placing a communication path 138 between the sensor 108 and a controller 214 mounted on the vibratory compactor 200.

Figure 4:
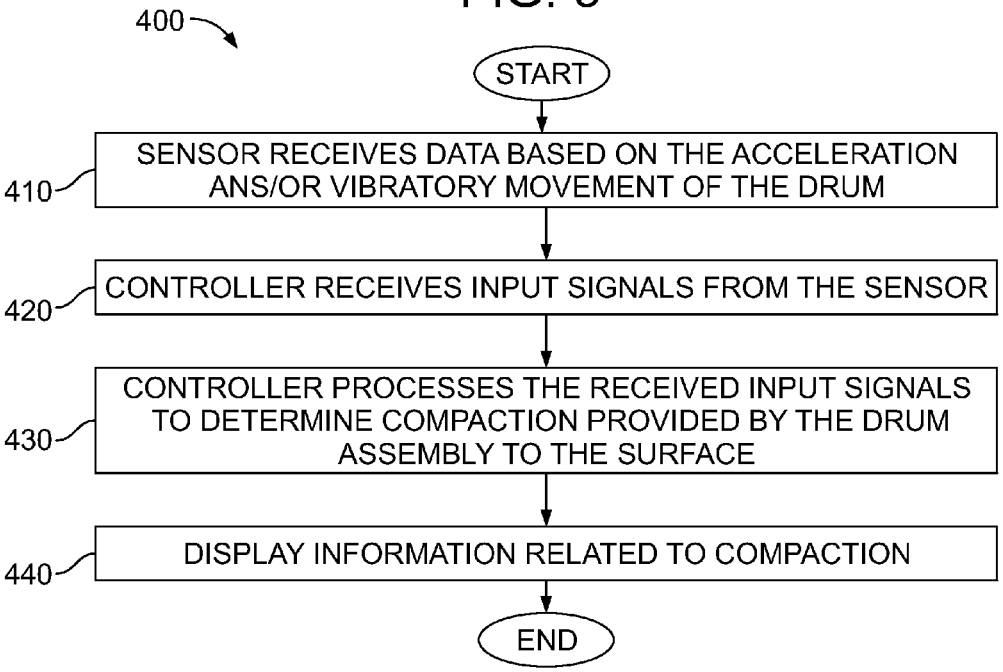
FIG. 4 is a flowchart illustrating exemplary blocks of a method for measuring the compaction provided by a vibratory compactor.

Referring now to FIG. 4, an exemplary flowchart is illustrated showing sample blocks which may be followed in a method 400 of measuring the compaction provided by the vibratory compactor 200. In block 410, the sensor 108 receives data based on the acceleration and/or vibratory movement of the drum 102. In block 420, the controller 214 receives input signals from the sensor 108. The input signals may be indicative of the drum 102 acceleration or vibratory movement. In block 430, the controller 214 processes the signals to determine the compaction provided by the drum assembly 100*a* to the surface 208. In block 440, the controller 214 may display information related to the compaction provided by the drum assembly 100*a* on the display 210 in the operator compartment 206. Alternatively, or in addition to, the controller 214 may transmit this information to a remote site for display or may store this information.

The features disclosed herein may be particularly beneficial for use with vibratory compactors 200. The ability to measure the compaction provided by the machine facilitates better control and use of the machine. It should be understood that the above description is intended for illustrative purposes only, and is not intended to limit the scope of the present disclosure in any way. Thus, those skilled in the art will appreciate that other aspects of the disclosure can be obtained from a study of the drawing, the disclosure, and the appended claims.

What is claimed is:

1. A drum assembly of a vibratory compactor having a frame, the drum assembly comprising:

a drum rotatably mounted on the frame, the drum including:
a shell;
a mounting wall disposed inside the drum; and
a bulkhead disposed inside the drum and attached to the shell;
a first bearing disposed between the frame and the mounting wall, the first bearing including a first bearing inner race fixedly mounted to the frame;
a second bearing comprising a hub and a bearing shaft circumscribed by the hub and mounted to the bulkhead of the drum, the bearing shaft rotatable with the drum;
a sensor mounted to the hub, the sensor configured to measure an acceleration of the drum; and
a strap having a first end and a second end, the first end attached to the first bearing inner race, and the second end attached to the hub, the strap configured to allow movement of the hub with respect to the first bearing inner race; whereby vibrations from the hub to the frame are reduced.

2. The drum assembly of claim 1, wherein the strap is flexible.

3. The drum assembly of claim 1, wherein the strap is wire mesh.

4. The drum assembly of claim 1, wherein the strap is made of an elastomeric material.

5. The drum assembly of claim 1, wherein the strap is a cord.

6. The drum assembly of claim 1, wherein rotational movement of the hub with respect to the first bearing inner race is in a range of about −30 degrees from a vertical axis V to about 30 degrees from the vertical axis V.

7. The drum assembly of claim 1, wherein the sensor is mounted indirectly to the hub.

8. The drum assembly of claim 1, wherein rotational movement of the hub with respect to the first bearing inner race is in a range of about −10 degrees from a vertical axis V to about 10 degrees from the vertical axis V.

9. A method of retrofitting a vibratory compactor having a drum with a sensor configured to measure an acceleration of the drum, the vibratory compactor including a frame, a drum rotatably mounted on the frame, a first bearing mounted on the frame, the first bearing including a first bearing inner race that is stationary relative to the drum, and a second bearing mounted inside the drum, the method comprising:
mounting the sensor to a portion of the second bearing;
attaching a first end of a strap to the first bearing inner race and a second end of the strap to the portion of the second bearing, wherein the strap is flexible;
restricting with the strap a rotational movement of the portion of the second bearing; and
placing a communication path between the sensor and a controller mounted on the vibratory compactor whereby the strap minimizes a rotational movement of the sensor to allow the sensor to make a more accurate measure of the acceleration of the drum.

10. The method of claim 9, wherein the strap is wire mesh.

11. The method of claim 9, wherein the strap is made of an elastomeric material.

12. The method of claim 9, wherein the strap is configured to allow rotational movement of the portion of the second bearing with respect to the first bearing inner race.

13. The method of claim 12, wherein the rotational movement of the portion of the second bearing with respect to the first bearing inner race is in a range of about −30 degrees from a vertical axis V to about 30 degrees from the vertical axis V.

14. A vibratory compactor comprising:
a frame;
a drum rotatably mounted on the frame, the drum including:
a shell;
a mounting wall disposed inside the shell; and
a bulkhead attached to the shell;
a vibratory motor mounted to the frame;
a drive shaft operably connected to the vibratory motor, the drive shaft extending through the bulkhead;
a first bearing disposed between the frame and the mounting wall, the first bearing including:
a first bearing outer race mounted to the mounting wall and rotatable with the drum; and
a first bearing inner race mounted to the frame, the first bearing inner race stationary with respect to the first bearing outer race;
a second bearing disposed between the mounting wall and the bulkhead and radially circumscribing the drive shaft, the second bearing comprising:
a hub; and
a bearing shaft circumscribed by the hub and mounted to the bulkhead of the drum and rotatable with the drum;
a mounting member fixedly attached to the hub;
a sensor mounted to the mounting member, the sensor configured to measure an acceleration of the drum; and
a strap having a first end and a second end, the first end attached to the first bearing inner race, and the second end attached to the hub, the strap is configured to allow a rotational movement of the hub with respect to the first bearing inner race whereby the strap minimizes a rotational movement of the sensor to allow the sensor to make a more accurate measure of the acceleration of the drum.

15. The vibratory compactor of claim 14, wherein the strap is a wire mesh strap.

16. The vibratory compactor of claim 15, wherein the strap is an elastic cord.

17. The vibratory compactor of claim 14, wherein the rotational movement of the hub with respect to the first bearing inner race is in a range of about −30 degrees from a vertical axis V to about 30 degrees from the vertical axis V.

18. The vibratory compactor of claim 14, wherein the rotational movement of the hub with respect to the first bearing inner race is in a range of about −10 degrees from a vertical axis V to about 10 degrees from the vertical axis V.

19. The vibratory compactor of claim 14, wherein the drum is a solid drum.

20. The vibratory compactor of claim 14, further including a bracket, wherein the bulkhead is disposed between the second bearing and the bracket.

* * * * *